United States Patent [19]

Easton

[11] 3,944,138

[45] Mar. 16, 1976

[54] LAWN SPRINKLER AND BIRD BATH STRUCTURE

[75] Inventor: Maysel Marie Easton, Miami, Fla.

[73] Assignee: Lawrence Peska Associates, Inc., New York, N.Y. ; a part interest

[22] Filed: May 29, 1975

[21] Appl. No.: 581,792

[52] U.S. Cl. ..... 239/18; 239/28; 239/211; 239/273; 239/289; 248/80; 248/159

[51] Int. Cl.[2].... B05B 17/08; B05B 1/00; F21P 7/00

[58] Field of Search ..... 239/17, 18, 28, 29.3, 31, 239/211, 289, 25, 32, 36, 275, 436, 273; 248/80, 159, 79; D23/8, 9; D29/1 R; 222/78

[56] References Cited

UNITED STATES PATENTS

| | | | |
|---|---|---|---|
| 490,378 | 1/1893 | Trouve | 239/18 |
| 579,371 | 3/1897 | Watson | 248/80 X |
| 731,517 | 6/1903 | Smith | 239/31 |
| 1,081,718 | 12/1913 | Brown | 239/31 X |
| 1,635,415 | 7/1927 | Hopper | 248/159 X |
| 1,989,525 | 1/1935 | Moore | 239/211 X |
| 2,788,918 | 4/1957 | Davis | 222/78 |

*Primary Examiner*—Robert S. Ward, Jr.

[57] ABSTRACT

A lawn sprinkler is provided with a first female hose fitting disposed in fluid communication with a housing having a base and interior chamber in fluid communication with the first fitting and a second fitting in fluid communication with the chamber. A sprinkler head is provided having a third fitting dimensioned and configured for engagement with the second fitting. The head has a plurality of petals representing a flower which has a plurality of fluid passageways disposed therein extending to the surface of the petals. The sprinkler head may be luminous and may also be selectively removed and replaced by a dished bird bath structure having a fitting cooperatively dimensioned and configured for engagement with the second fitting.

3 Claims, 4 Drawing Figures

LAWN SPRINKLER AND BIRD BATH STRUCTURE

BACKGROUND OF THE INVENTION

The invention relates to lawn and garden equipment and particularly to lawn sprinklers. The prior art includes various lawn sprinklers which in general have not been aesthetically appealing, have had only one use and in some cases pose a hazard for people walking on the lawn in dim lighting. Apparatus having a very general similarity to the apparatus of the present invention includes that shown in the following U.S. Pat. Nos.: Requa, 1,929,825; Moore, 1,989,525; Forman, 2,611,645; Koniskson, 2,884,200; and Butt U.S. Design Pat. No. 100,087. It is a primary purpose of the invention to provide apparatus which is aesthetically pleasing, which avoids potential hazards due to tripping over the lawn sprinkler in darkness and which has a dual purpose.

It is still another object of the invention to provide apparatus which is simple and inexpensive to manufacture.

SUMMARY OF THE INVENTION

It has now been found that these and other objects of the invention may be attained by a water sprinkler which comprises a first female hose fitting and a housing having an interior chamber in fluid communication with the first fitting and also a second fitting carried on the housing. The housing provides a base for support of the assembly. A sprinkler head is provided having a third fitting dimensioned and configured for engagement with the second fitting and which includes a plurality of three dimensional representations of flowers including petals include a plurality of passageways disposed therein communicating with the third fitting.

In one form of the invention the sprinkler head is luminous. The sprinkler head may be selectively removed and replaced by a generally horizontally dished bird bath member and which has a fitting cooperatively dimensioned and configured for engagement with the second fitting when the sprinkler head is removed.

BRIEF DESCRIPTION OF THE DRAWING

The invention will be better understood by reference to the accompanying drawing in which.

DESCRIPTION OF THE PREFERRED EMBODIMENT

Figure 1:
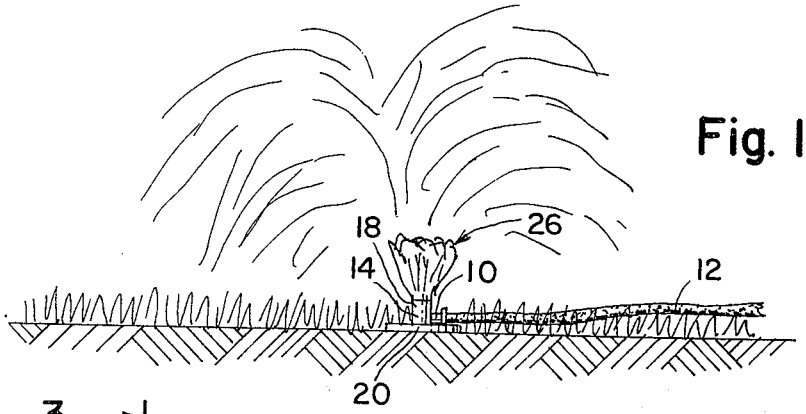
FIG. 1 is a side elevational view of one form of the apparatus in accordance with the invention.
Figure 2:
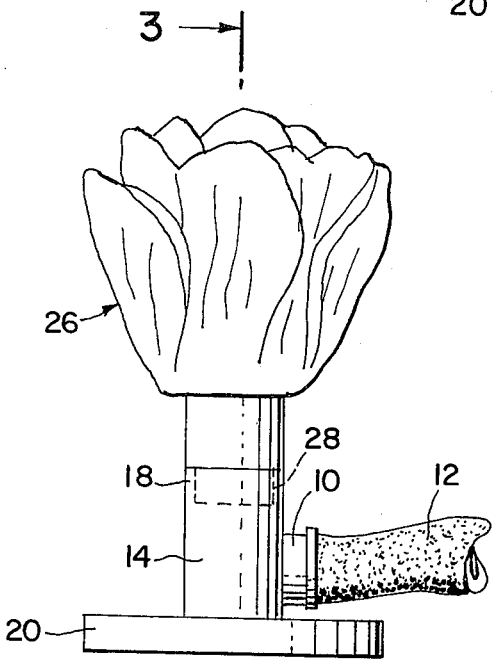
FIG. 2 is a side elevational view to an enlarged scale of the apparatus shown in FIG. 1.
Figure 3:
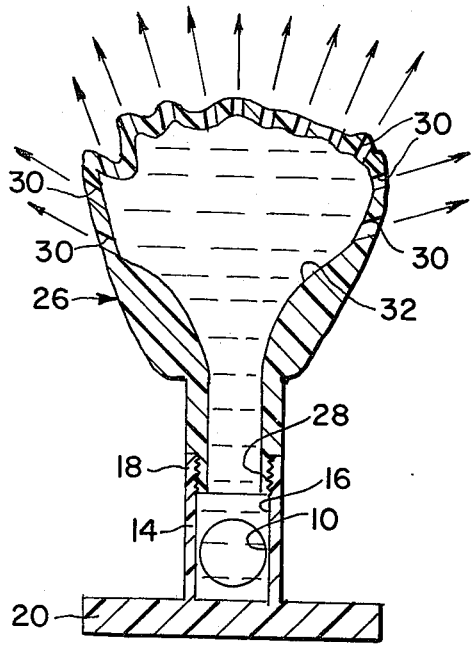
FIG. 3 is a sectional view taken through the line 3—3 of FIG. 2.

Referring now to FIGS. 1 through 3 there is shown a first fitting 10 which is coupled to a garden hose 12. The coupling is carried by a housing 14 having an interior chamber 16 which is in fluid communication with the coupling 10 and a second coupling 18. The housing includes a base 20 which is generally planar and which supports the entire assembly.

Engaging the second coupling or fitting 18 is a sprinkler head 26 having fitting 28 dimensioned and configured for engagement with the fitting 18. In the preferred form the sprinkler head 26 is hollow and has a plurality of passageways for the passage of water which enters through the garden hose 12 and passes via the chamber 16 to the interior 32 of the head 26. In one form of the invention the head 26 is manufactured of a luminous material and which may be a plastic. It has been found that the apparatus so manufactured substantially reduces the danger of tripping over the sprinkler which must by necessity be placed away from the side of the lawn to do an efficient watering job.

Figure 4:
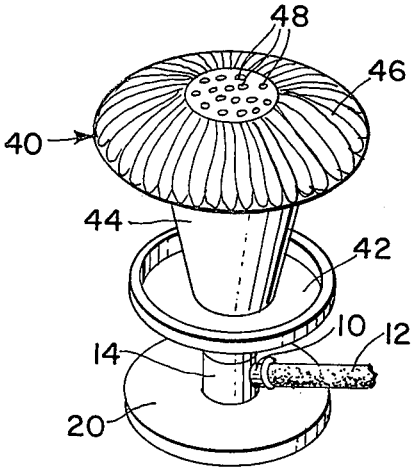
FIG. 4 is a perspective view of a bird bath which may be selectively positioned on the housing shown in FIGS. 1 through 3.

Another form of the invention is shown in FIG. 4 wherein the garden hose 12 is used to supply water through the same housing 14 which is supported on the same base 20. The removable bird bath 40 includes a dished member 42, an upstanding truncated conical support 44 and an umbrella shaped member 46 having a plurality of passageways 48. It will be understood that the passageways 48 are in fluid communication with the interior of the housing 14 and that this arrangement permits a dual use not only for lawn sprinklers, but also for providing a suitable place for a bird bath. More particularly it will be understood that the dished surface 42 will be used for birds. If desired the dished surface 42 may also be used for feeding birds.

Having thus described my invention, I claim:

1. A water sprinkler which comprises: a first hose fitting, a housing having an interior chamber in fluid communication with said first hose fitting, said housing having a second fitting carried on said housing and disposed in fluid communication with said chamber, said housing further including a base for support thereof, a sprinkler head having a third fitting dimensioned and configured for selective engagement with said second fitting, said sprinkler including a plurality of three dimensional representations of flowers including petals, said petals having a plurality of passageways disposed therein communicating with said third fitting.

2. The apparatus as described in claim 1 wherein said sprinkler head is manufactured of a luminescent material.

3. The apparatus as described in claim 1 wherein said sprinkler includes a generally horizontal dished member having a fitting cooperatively dimensioned and configured for selective engagement with said second fitting when said sprinkler head is removed.

* * * * *